US006246166B1

(12) United States Patent
Bae et al.

(10) Patent No.: US 6,246,166 B1
(45) Date of Patent: Jun. 12, 2001

(54) ELECTRODE OF ELECTRON GUN FOR CATHODE RAY TUBE

(75) Inventors: Min-cheol Bae; Sang-won Shin, both of Suwon (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/336,700

(22) Filed: Jun. 21, 1999

(30) Foreign Application Priority Data

Nov. 25, 1998 (KR) ..... 98-23082

(51) Int. Cl.[7] ..... H01J 29/46

(52) U.S. Cl. ..... 313/446; 313/410; 313/414

(58) Field of Search ..... 313/414, 458, 313/446, 447, 491, 631

*Primary Examiner*—Vip Patel
(74) *Attorney, Agent, or Firm*—Lowe Hauptman Gilman & Berner, LLP

(57) ABSTRACT

An electrode of an electron gun for a cathode ray tube with an improved structure so as to enhance the flatness of the electrode. The electrode includes an electron beam passing plane on which one or more electron beam passing holes are formed, an upper sloping portion of a truncated cone shape, slantingly extending downward and outward from the peripheral edges of the electron beam passing plane, and a vertically extending portion of a cylindrical shape, extending downward from the lower portion of the upper sloping portion and extending substantially perpendicular to the electron beam passing plane.

3 Claims, 3 Drawing Sheets

ELECTRODE OF ELECTRON GUN FOR CATHODE RAY TUBE

BACKGROUND OF THE INVENTION

1. Field of the Invention

The present invention relates to an electrode of an electron gun for a cathode ray tube (CRT), and more particularly, to an electrode of an electron gun for a CRT with an improved structure so as to enhance flatness of the electrode.

2. Description of the Related Art

Generally, an electron gun for a CRT is formed by embedding a cathode and a plurality of electrodes constituting an electrostatic lens in a bead glass such that they are spaced apart from one another. The embedded part of the electrode for an electron gun is usually fixed on the bead glass using a fusion splicer. As shown in FIG. 1, a heated bead glass 100 mounted on a holder 12 is pressed on electrode supports 14*a* of the electrodes 14 at both sides of an electrode assembly 11 on which a plurality of electrodes 14 constituting an electron gun are supported, so that the electrode supports 14 are embedded in the bead glass 100.

However, when the electrodes of an electron gun for a CRT are assembled in such a manner, a stress due to pressing of the bead glass 100 is applied to the electrode supports 14*a* of the electrodes 14, which is eventually applied the overall electrodes. Thus, the flatness of an electron beam passing plane on which electron beam passing holes are formed is significantly degraded.

Also, in the course of a pressing process performed for forming an electrode into a predetermined shape, a residual stress applied to the electrode due to plastic deformation deforms the electrode, by which the flatness of the electron beam passing plane may be degraded.

If the flatness of electrodes of an electron gun is worsened due to the above-described factors, the electrostatic lens formed between electrodes of the electron gun may be distorted, thereby disabling to focus and accelerate electron beams in a desirable manner.

SUMMARY OF THE INVENTION

To solve the above problem, it is an object of the present invention to provide

It is another object of the present invention to provide an electrode of an electron gun for a cathode ray tube which can prevent the flatness of an electron beam passing plane of the electrode from being degraded during electrode assembly and fabrication, by increasing the structural strength of the electrode.

Accordingly, to achieve the above object, there is provided an electrode of an electron gun for a cathode ray tube including an electron beam passing plane on which one or more electron beam passing holes are formed, an upper sloping portion of a truncated cone shape, slantingly extending downward and outward from the peripheral edges of the electron beam passing plane, and a vertically extending portion of a cylindrical shape, extending downward from the lower portion of the upper sloping portion and extending substantially perpendicular to the electron beam passing plane.

According to another aspect of the present invention, there is an electrode of an electron gun for a CRT further including a lower sloping portion of a truncated cone shape, slantingly extending downward and outward from the lower portion of the vertically extending portion, and a flange extending from the lower portion of the lower sloping portion in a direction substantially parallel to the electron beam passing plane.

Preferably, the conical generatrices of the upper and lower sloping portions are curved.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

Hereinbelow, preferred embodiments of the present invention will be described in detail with reference to the accompanying drawings.

Figure 2:
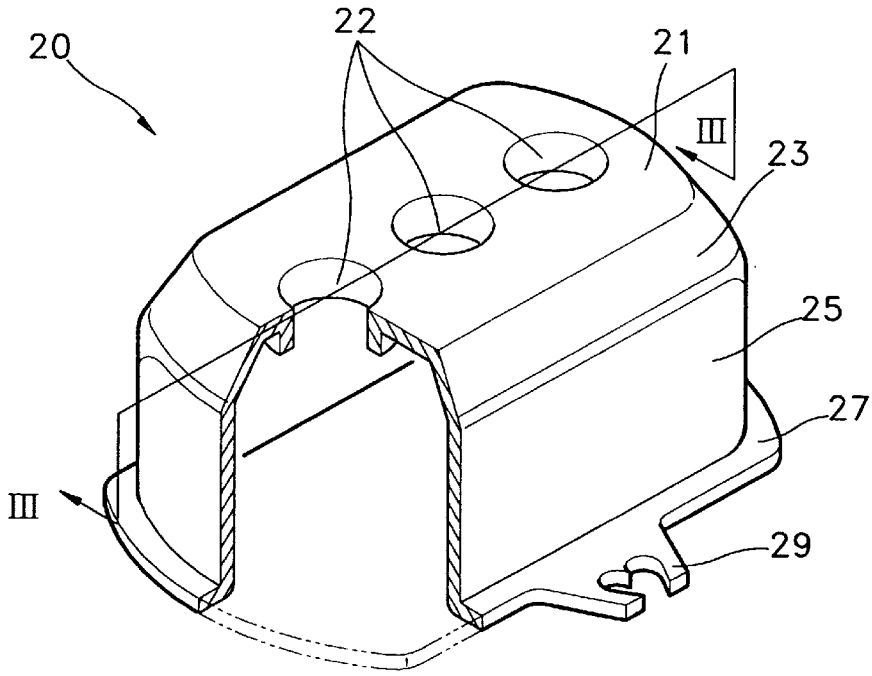
FIG. 2 is a perspective view illustrating a first embodiment of an electrode of an electron gun for a cathode ray tube according to the present invention.
Figure 3:
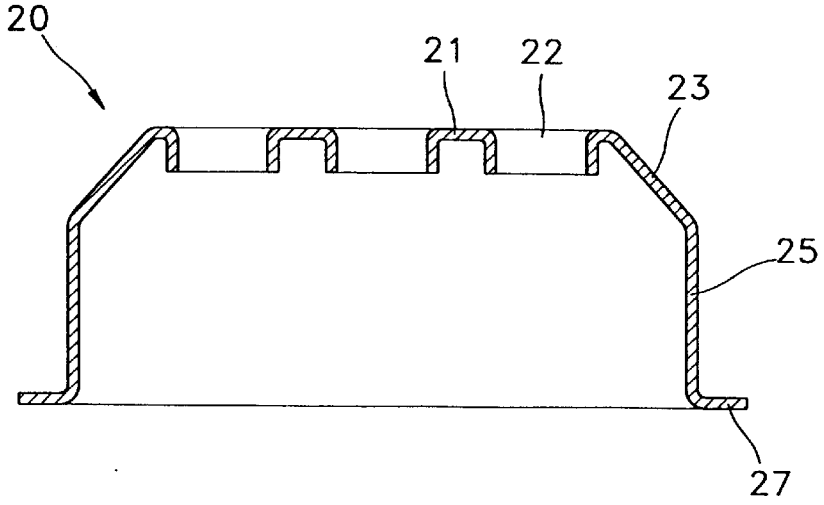
FIG. 3 is a sectional view taken along line III—III shown in FIG. 2.

FIGS. 2 and 3 illustrate a first embodiment of an electrode of an electron gun for a cathode ray tube according to the present invention.

As shown, an electrode 20 of this embodiment includes an electron beam passing plane 21, a vertically extending portion 25 of a cylindrical shape, substantially vertically extending with respect to the electron beam passing plane 25, and an upper sloping portion 23 of a substantially truncated cone shape, interposed between the electron beam passing plane 21 and the vertically extending portion 25.

Figure 1:
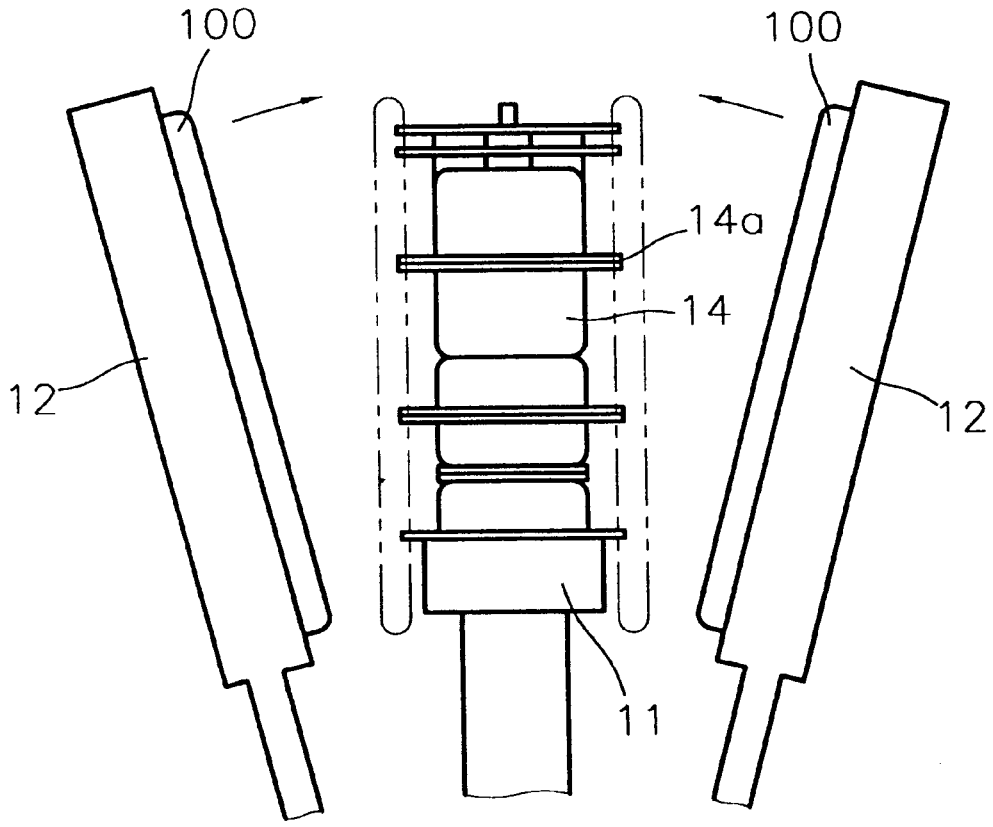
FIG. 1 (PRIOR ART)
FIG. 1 is an operation conceptual diagram illustrating a general process of fusion-splicing an electrode of an electron gun for a cathode ray tube in a bead glass.

The electron beam passing plane 21 is substantially elliptic and has three electron beam passing holes 22 in-line arranged thereon. The upper sloping portion 23 is formed of a truncated cone shape, that is, the cross-sectional area thereof gets larger from the electron beam passing plane 21 to the vertically extending portion 25. The upper portion of the upper sloping portion 23 extends from the periphery of the electron beam passing plane 21 and the lower portion thereof is led to the vertically extending portion 25. Thus, the electron beam passing plane 21 has an area smaller than the cross-sectional area of the vertically extending portion 25. A flange 27 extending outwardly is provided in the lower edge of the vertically extending portion 25. An electrode support 27 embedded in the bead glass (100 of FIG. 1) during the fusion splicing process is provided.

Preferably, the electron beam passing plane 21, the upper sloping portion 23, the vertically extending portion 25 and the flange 27 are integrally formed by a pressing process.

Figure 4:
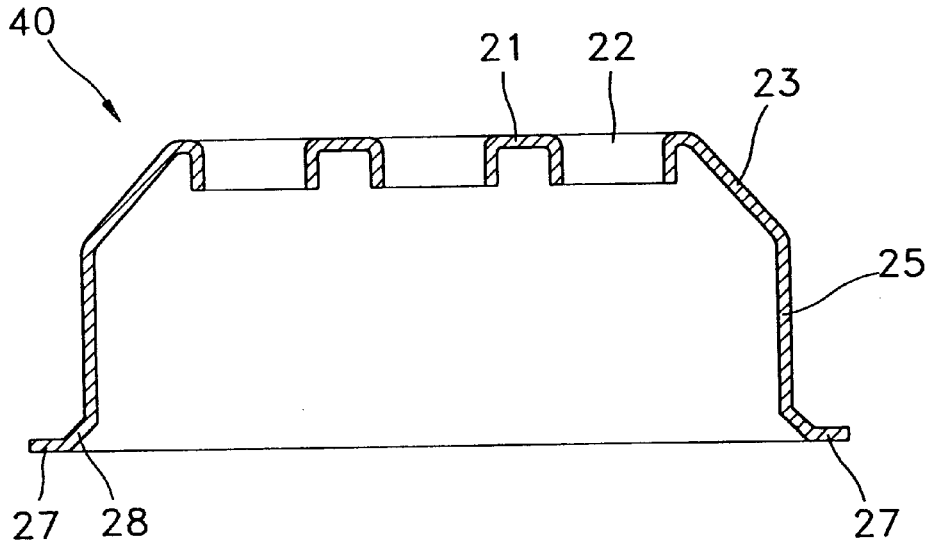
FIG. 4 is a perspective view illustrating a second embodiment of an electrode of an electron gun for a cathode ray tube according to the present invention.

FIG. 4 is a perspective view illustrating a second embodiment of an electrode of an electron gun for a cathode ray tube according to the present invention, in which the same reference numbers represent the same elements as those in the first embodiment and the detailed explanation thereof will be omitted.

The characteristic feature of this embodiment is in that a lower sloping portion 28 of a truncated cone shape is interposed between a vertically extending portion 25 of an electrode 40 and a flange 27. In other words, the lower sloping portion 28 slantingly extends downward and outward from the lower portion of the vertically extending portion 25. The flange 27 extends from the lower portion of the lower sloping portion 28 in a direction substantially parallel to an electron beam passing plane 21.

Figure 5:
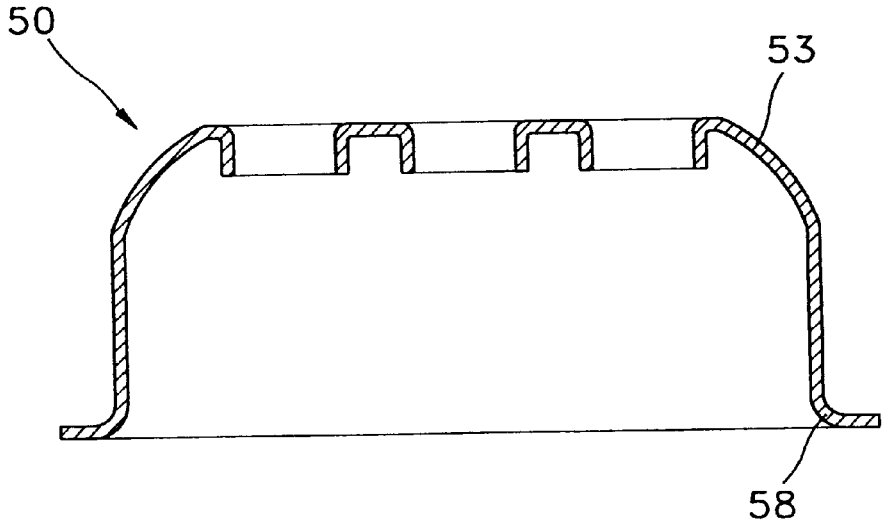
FIG. 5 is a perspective view illustrating a third embodiment of an electrode of an electron gun for a cathode ray tube according to the present invention.

FIG. 5 is a perspective view illustrating a third embodiment of an electrode of an electron gun for a cathode ray tube according to the present invention. An electrode 50 of this embodiment is characterized in that the conical generatrices of upper and lower sloping portions 53 and 58 of the electrode 50 are curved. The other elements of the electrode 50 other than the above-described characteristic part are the same as those 20 and 40 in the first and second embodiments, and the detailed explanation thereof will be omitted.

In the electrodes 20 and 40 thus constructed, the stress directly applied to the electrode support 29 or the vertically extending portion 25 during a fusion splicing process is somewhat distributed to the upper sloping portion 23 before it is delivered to the electron beam passing plane 21. Thus, the impairment of the flatness of the electron beam passing plane 21 is considerably avoidable. Also, since the area occupied by the electron beam passing plane 21 is reduced by providing the upper sloping portion 23, which is a main feature of the present invention, the strength of the electron beam passing plane 21 is increased. Therefore, an electrode having an electron beam passing plane with a good flatness can be provided by pressing materials for the purpose of attaining the above-described configuration.

In the electrode 40 shown in FIG. 4, since each sloping portion is formed in the upper and lower portions thereof, the structural strength of the electrode 40 is further increased.

As described above, the electrode of an electron gun for a CRT can enhance the flatness of a electron beam passing plane. Thus, the distortion of an electric field created between electrodes of an electron gun employing the electrode according to the present invention can be minimized. Therefore, such an electron gun can focus and accelerate an electron beam in a desirable manner, resulting in high quality of the electron gun.

Although preferred embodiments of the present invention have been described in detail hereinabove, they are used in a generic and descriptive sense only and not for the purpose of limiting. Thus, it should be clearly understood that many variations and/or modifications may be effected by those skilled in the art without departing from the spirit and scope of the present invention, as defined in the appended claims.

What is claimed is:

1. An electrode of an electron gun for a cathode ray tube comprising:

an electron beam passing plane on which one or more electron beam passing holes are formed;

an upper sloping portion of a truncated cone shape, slantingly extending downward and outward from the peripheral edges of the electron beam passing plane; and a vertically extending portion of a cylindrical shape, extending downward from the lower portion of the upper sloping portion and extending substantially perpendicular to the electron beam passing plane.

2. The electrode according to claim 1, further comprising:

a lower sloping portion of a truncated cone shape, slantingly extending downward and outward from the lower portion of the vertically extending portion; and a flange extending from the lower portion of the lower sloping portion in a direction substantially parallel to the electron beam passing plane.

3. The electrode according to claim 1, wherein the conical generatrices of the upper and lower sloping portions are curved.

* * * * *